US012022985B2

(12) United States Patent
Zhang et al.

(10) Patent No.: US 12,022,985 B2
(45) Date of Patent: Jul. 2, 2024

(54) METHOD AND DEVICE FOR CONTROLLING ROBOT CLEANER, ROBOT CLEANER AND STORAGE MEDIUM

(71) Applicant: SHENZHEN FLY RODENT DYNAMICS INTELLIGENT TECHNOLOGY CO., LTD., Guangdong (CN)

(72) Inventors: Hao Zhang, Guangdong (CN); Ruijun Yan, Guangdong (CN); Li Lei, Guangdong (CN)

(73) Assignee: SHENZHEN FLY RODENT DYNAMICS INTELLIGENT TECHNOLOGY CO., LTD., Shenzhen (CN)

( * ) Notice: Subject to any disclaimer, the term of this patent is extended or adjusted under 35 U.S.C. 154(b) by 341 days.

(21) Appl. No.: 17/550,673

(22) Filed: Dec. 14, 2021

(65) Prior Publication Data

US 2022/0265109 A1 Aug. 25, 2022

(30) Foreign Application Priority Data

Feb. 23, 2021 (CN) ..... 202110201044.0

(51) Int. Cl.
*A47L 11/40* (2006.01)
*A47L 11/29* (2006.01)

(52) U.S. Cl.
CPC ..... *A47L 11/4011* (2013.01); *A47L 11/29* (2013.01); *A47L 11/4019* (2013.01); *A47L 2201/04* (2013.01)

(58) Field of Classification Search
CPC .. A47L 11/4011; A47L 11/29; A47L 11/4019; A47L 2201/04; A47L 11/4008;
(Continued)

(56) References Cited

U.S. PATENT DOCUMENTS 10,390,672 B2 8/2019 Jung et al.
2004/0088816 A1 5/2004 Shimizu et al.
(Continued)

FOREIGN PATENT DOCUMENTS

CN 103961037 A 8/2014
CN 107224251 A 10/2017
(Continued)

OTHER PUBLICATIONS

International Search Report for International Application No. PCT/CN2021/135570; Mailing Date, Feb. 25, 2022.
(Continued)

*Primary Examiner* — Adam R Mott
*Assistant Examiner* — Byron Xavier Kasper
(74) *Attorney, Agent, or Firm* — Samson G. Yu

(57) ABSTRACT

This application provides a method for controlling a robot cleaner, a robot cleaner, and a storage medium. The method for controlling the robot cleaner includes the steps of: acquiring a weight of the water tank, comparing the weight of the water tank with a setting value to acquire a comparison result, determining a remaining usable time of the robot cleaner according to the comparison result, and controlling the robot cleaner according to the remaining usable time. Since the weight of the water tank is not easily interfered by other factors, the acquiring of weight has a high accuracy, thereby the remaining usable time determined according to the weight of the water tank has a high accuracy, and then the robot cleaner is controlled according to the remaining usable time with higher accuracy. The control accuracy of the robot cleaner thus can be improved.

13 Claims, 5 Drawing Sheets

(58) Field of Classification Search
CPC ..... A47L 11/4083; A47L 11/02; A47L 11/10; A47L 11/34; A47L 40/13; A47L 11/4016; A47L 11/4022; A47L 11/4027; A47L 11/403; B25J 9/00; B25J 9/16; B25J 11/0085; G05D 1/648; G05D 11/04
See application file for complete search history.

(56) References Cited

U.S. PATENT DOCUMENTS

| | | | | |
|---|---|---|---|---|
| 2012/0169497 | A1* | 7/2012 | Schnittman | A47L 9/2894 340/540 |
| 2015/0136176 | A1* | 5/2015 | Aldrich | A47L 11/145 134/6 |
| 2021/0187732 | A1* | 6/2021 | Chae | B25J 9/1661 |
| 2021/0282613 | A1* | 9/2021 | Fong | G05D 1/0044 |

FOREIGN PATENT DOCUMENTS

| | | | | |
|---|---|---|---|---|
| CN | 206548443 | U | * 10/2017 | |
| CN | 108870636 | A | 11/2018 | |
| CN | 109602356 | A | 4/2019 | |
| CN | 109864667 | A | 6/2019 | |
| CN | 209252712 | U | 8/2019 | |
| CN | 210056853 | U | 2/2020 | |
| CN | 210990091 | U | 7/2020 | |
| CN | 113143127 | A | 7/2021 | |
| EP | 3524117 | A2 | 8/2019 | |
| EP | 3730019 | A1 | * 10/2020 | A47L 11/30 |
| KR | 2020002740 | U | * 12/2020 | A47L 11/24 |

OTHER PUBLICATIONS

Written Opinion for International Application No. PCT/CN2021/135570; Mailing Date, Feb. 25, 2022.
Chinese Office Action for Chinese Application No. 202110201044.0 dated Dec. 27, 2021.
Search Report for Chinese Application No. 202110201044.0 dated Dec. 7, 2021.
Translation of Chinese Office Action for Chinese Application No. 202110201044.0 dated Dec. 27, 2021.

* cited by examiner

METHOD AND DEVICE FOR CONTROLLING ROBOT CLEANER, ROBOT CLEANER AND STORAGE MEDIUM

CROSS-REFERENCE TO RELATED APPLICATION

Pursuant to 35 U.S.C. § 119 and the Paris Convention, this application claims the benefit of Chinese Patent Application No. 202110201044.0 filed on Feb. 23, 2021, the entire content of which is incorporated herein by reference.

TECHNICAL FIELD

The present application relates to the field of smart device technologies, and more particularly to a method and a device for controlling a robot cleaner, a robot cleaner and a storage medium.

BACKGROUND

With advances in technology, more and more home automations have entered people's lives. A robot cleaner has a function of automatically cleaning without user intervention, and has been widely used in daily life.

In the robot cleaner, a clean-water tank is provided for containing clean water used in a cleaning process, and a dirty water tank is provided for containing dirty water recovered during the cleaning process. Existing robot cleaners generally use a magnetic sensor on a top or bottom of the water tank to detect a position of a float in the water tank. It is judged that the water tank is full of water when the float touches the magnetic sensor on the top of the water tank is detected. It is judged that the water tank has no water when the float touches the magnetic sensor at the bottom of the water tank is detected. However, the use of floats and magnetic sensors to detect the amount of water in the water tank has a problem of inaccurate detection. If the judgment of the amount of water in the water tank is inaccurate, the calculated remaining usable time of the robot cleaner will be inaccurate, and thus an accurate control of the robot cleaner cannot be guaranteed.

SUMMARY

In view of the above background, embodiments of the present application provide a method for controlling a robot cleaner, a device, a robot cleaner, and a storage medium, so as to improve a control accuracy of robot cleaner.

In accordance with a first aspect of the embodiments of the present application, it is provided a method for controlling a robot cleaner, which is applied to a robot cleaner, the robot cleaner includes a water tank, and the method for controlling the robot cleaner includes the following steps:

acquiring a weight of the water tank;

comparing the weight of the water tank with a setting value to acquire a comparison result;

determining a remaining usable time of the robot cleaner according to the comparison result; and controlling the robot cleaner according to the remaining usable time.

In a possible implementation manner, the step of determining a remaining usable time of the robot cleaner according to the comparison result includes:

determining the remaining usable time of the robot cleaner according to the comparison result and a working mode of the robot cleaner.

In a possible implementation manner, after the step of determining a remaining usable time of the robot cleaner according to the comparison result, the method for controlling the robot cleaner also includes:

acquiring a worked time of the robot cleaner; and determining a state of water amount in the water tank according to the worked time, the remaining usable time, and the comparison result.

In a possible implementation manner, the water tank includes a first water tank configured for containing clean water to be used in a cleaning process, and the setting value is a weight of the first water tank in an anhydrous state.

In a possible implementation manner, the step of determining a state of water amount in the water tank according to the worked time, the remaining usable time, and the comparison result includes:

determining that the first water tank has no water but has impurities, when the worked time is greater than or equal to the remaining usable time, and the weight of the first water tank is greater than the weight of the first water tank in the anhydrous state.

In a possible implementation manner, the step of determining a state of water amount in the water tank according to the worked time, the remaining usable time, and the comparison result includes:

determining that the first water tank has water left, when the worked time is less than the remaining usable time, and the weight of the first water tank is greater than the weight of the first water tank in the anhydrous state.

In a possible implementation manner, the step of determining a state of water amount in the water tank according to the worked time, the remaining usable time, and the comparison result includes:

determining that the first water tank has no water and no impurities, when the worked time is greater than or equal to the remaining usable time, and the weight of the first water tank is equal to the weight of the first water tank in the anhydrous state.

In a possible implementation manner, the water tank includes a second water tank configured for containing dirty water recovered in the cleaning process, and the setting value is a weight of the second water tank in a state of being filled with water.

In a possible implementation manner, the step of determining a state of water amount in the water tank according to the worked time, the remaining usable time, and the comparison result includes:

determining that the second water tank is not full of water and has impurities, when the worked time is less than the remaining usable time, and the weight of the second water tank is greater than or equal to the weight of the second water tank in the state of being filled with water.

In a possible implementation manner, the step of determining a state of water amount in the water tank according to the worked time, the remaining usable time, and the comparison result includes:

determining that the second water tank is not full of water, when the worked time is less than the remaining usable time, and the weight of the second water tank is less than the weight of the second water tank in the state of being filled with water.

In a possible implementation manner, the step of determining a state of water amount in the water tank according to the worked time, the remaining usable time, and the comparison result includes:

determining that the second water tank is full of water, when the worked time is greater than or equal to the remaining usable time, and the weight of the second water tank is greater than or equal to the weight of the second water tank in the state of being filled with water.

In a possible implementation manner, after the step of acquiring a weight of the water tank, the method for controlling the robot cleaner also includes:

determining that a filter screen of the water tank is blocked, when the weight of the water tank does not change within a preset duration.

In accordance with a second aspect of the embodiments of the present application, it is provided a device for controlling a robot cleaner, which is applied to a robot cleaner, the robot cleaner includes a water tank, and the device for controlling the robot cleaner includes:

an acquisition module, which is configured to acquire a weight of the water tank;

a comparison module, which is configured to compare the weight of the water tank with a setting value to acquire a comparison result;

a calculation module, which is configured to determine a remaining usable time of the robot cleaner according to the comparison result;

a control module, which is configured to control the robot cleaner according to the remaining usable time.

In a possible implementation manner, the calculation module is specifically configured to:

determine the remaining usable time of the robot cleaner according to the comparison result and a working mode of the robot cleaner.

In a possible implementation manner, the device for controlling the robot cleaner also includes a determining module, and the determining module is configured to:

acquire a worked time of the robot cleaner; and determine a state of water amount in the water tank according to the worked time, the remaining usable time, and the comparison result.

In a possible implementation manner, the water tank includes a first water tank configured for containing clean water to be used in a cleaning process, and the setting value is a weight of the first water tank in an anhydrous state.

In a possible implementation manner, the determining module is specifically configured to:

determine that the first water tank has no water but has impurities, when the worked time is greater than or equal to the remaining usable time, and the weight of the first water tank is greater than the weight of the first water tank in an anhydrous state.

In a possible implementation manner, the determining module is specifically configured to:

determine that the first water tank has water left, when the worked time is less than the remaining usable time, and the weight of the first water tank is greater than the weight of the first water tank in an anhydrous state.

In a possible implementation manner, the determining module is specifically configured to:

determine that the first water tank has no water and no impurities, when the worked time is greater than or equal to the remaining usable time, and the weight of the first water tank is equal to the weight of the first water tank in an anhydrous state.

In a possible implementation manner, the water tank includes a second water tank configured for containing dirty water recovered in the cleaning process, and the setting value is a weight of the second water tank in a state of being filled with water.

In a possible implementation manner, the determining module is specifically configured to:

determine that the second water tank is not full of water, and has impurities, when the worked time is less than the remaining usable time, and the weight of the second water tank is greater than or equal to the weight of the second water tank in the state of being filled with water.

In a possible implementation manner, the determining module is specifically configured to:

determine that the second water tank is not full of water, when the worked time is less than the remaining usable time, and the weight of the second water tank is less than the weight of the second water tank in the state of being filled with water.

In a possible implementation manner, the determining module is specifically configured to:

determine that the second water tank is full of water, when the worked time is greater than or equal to the remaining usable time, and the weight of the second water tank is greater than or equal to the weight of the second water tank in a state of being filled with water.

In a possible implementation manner, the determining module is further configured to:

determine that a filter screen of the water tank is blocked, when the weight of the water tank does not change within the preset duration.

In accordance with a third aspect of the embodiments of the present application, it is provided a robot cleaner, which includes a memory, a processor, and a computer program stored in the memory and running on the processor. The processor, by executing the computer program, is configured to implement the method for controlling the robot cleaner as described in the above-mentioned first aspect.

In accordance with a fourth aspect of the embodiments of the present application, it is provided a computer-readable storage medium, the computer-readable storage medium stores a computer program, and when the computer program is executed by a processor, the method for controlling the robot cleaner as described in the first aspect is implemented.

In accordance with a fifth aspect of the embodiments of the present application, it is provided a computer program product, when the computer program product runs on a robot cleaner, the robot cleaner performs the method for controlling the robot cleaner described in the first aspect.

Compared with the existing technologies, the embodiments of the present application have the following beneficial effects: by acquiring a weight of the water tank, and comparing the weight of the water tank with a setting value, a comparison result is acquired, and according to comparison result, a remaining usable time of the robot cleaner is determined. Since the weight of the water tank is not easily interfered by other factors, the acquiring of weight has a high accuracy, thereby the remaining usable time determined according to the weight of the water tank has a high accuracy, and then the robot cleaner can be controlled according to the determined remaining usable time with high accuracy. The control accuracy of the robot cleaner thus can be improved.

BRIEF DESCRIPTION OF THE DRAWINGS

In order to illustrate the technical solutions in the embodiments of the present application more clearly, the drawings that need to be used in the description of the embodiments or exemplary technologies will be briefly described herein below.

DETAILED DESCRIPTION OF THE EMBODIMENTS

In the following description, for purpose of illustration rather than limitation, specific details such as a specific system structure and technology are provided for a thorough understanding of the embodiments of the present application. However, it could be anticipated to those skilled in the art that the present application can also be implemented in other embodiments without these specific details. In other cases, detailed descriptions of well-known systems, devices, circuits, and methods are omitted to avoid unnecessary details from obstructing the description of the present application.

It should be understood that the term "comprise/include" used in this specification and appended claims, indicates an existence of the described features, wholes, steps, operations, elements and/or components, but does not exclude the existence or addition of one or more other features, wholes, steps, operations, elements, components, and/or a combination thereof.

A robot cleaner includes a clean water tank and a dirty water tank. The clean water tank is configured for containing clean water in a cleaning process. The dirty water tank is configured for containing dirty water recovered during the cleaning process. In order to realize a control of the robot cleaner, it is necessary to know an amount of water in the clean water tank and the dirty water tank.

Figure 1:
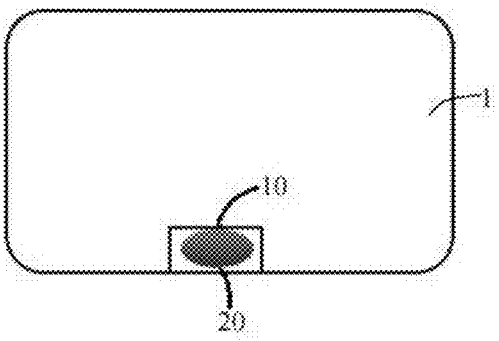
FIG. 1 is a top view of a water tank in accordance with an embodiment of the present application.

As shown in FIG. 1, in a possible implementation manner, a filter screen 10 is installed in the water tank 1 (a clean water tank or a dirty water tank), and a float 20 is provided inside the filter screen 10. The float 20 moves up and down depending on the amount of water. A magnetic sensor is arranged at one end of the filter screen 10, and the float 20 will contact the magnetic sensor during a change of water amount. According to whether the float 20 touches the magnetic sensor, a position of the float 20 can be determined, and then the amount of water in the water tank can be determined.

Figure 2:
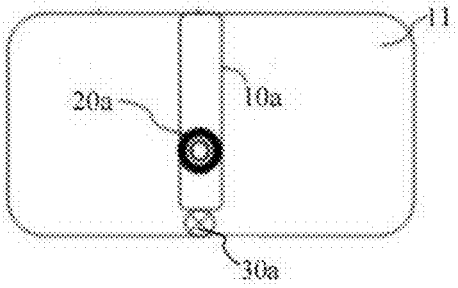
FIG. 2 is a side view of a clean water tank in accordance with an embodiment of the present application.
Figure 3:
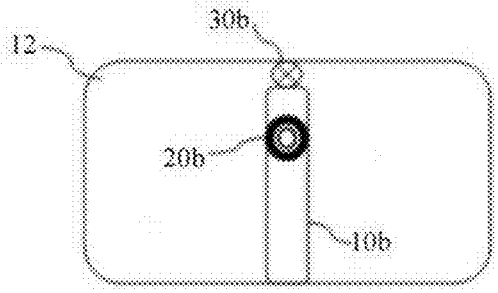
FIG. 3 is a side view of a dirty water tank in accordance with an embodiment of the present application.

Specifically, as shown in FIG. 2, a filter screen 10*a*, a float 20*a*, and a magnetic sensor 30*a* are provided in the clean water tank 11. When it is detected that the float 20*a* touches the magnetic sensor 30*a* at the bottom of the clean water tank 11, it is determined that the clean water tank has no water. As shown in FIG. 3, a filter screen 10*b*, float 20*b* and a magnetic sensor 30*b* are provided in the dirty water tank 12. When it is detected that the float 20*b* touches the magnetic sensor 30*b* on the top of the dirty water tank 12, it is determined that the dirty water tank is full of water.

However, the use of floats and magnetic sensors to detect the amount of water in the water tank may result in an inaccurate detection of water amount. For example, after the water tank has been used for a period of time, dirt and sand will accumulate between the filter screen and the magnetic sensor, causing the float to not touch the magnetic sensor, which makes it impossible to accurately determine the amount of water in the water tank. When detergent is added to the water tank, some cleaning agents have a certain degree of adhesion, which may affect the rise or fall of the float, resulting in low detection sensitivity. During a working process of the cleaning robot, the water tank may be shaken, and the float may mistakenly touch the magnetic sensor as the water tank shakes, causing false alarms.

To this end, the present application provides a method for controlling a robot cleaner, which includes the following steps: acquiring a weight of the water tank, comparing the weight of the water tank with a setting value to acquire a comparison result, determining a remaining usable time of the robot cleaner according to the comparison result and controlling the robot cleaner according to the remaining usable time. Since the weight of the water tank is not easily interfered by other factors, the acquiring of weight has a high accuracy, thereby the remaining usable time determined according to the weight of the water tank is in a high accuracy, and then the robot cleaner is controlled according to the remaining usable time with high accuracy. The control accuracy of the robot cleaner thus can be improved.

The following is an exemplary method for controlling the robot cleaner in accordance with an embodiment of the present application.

Figure 4:
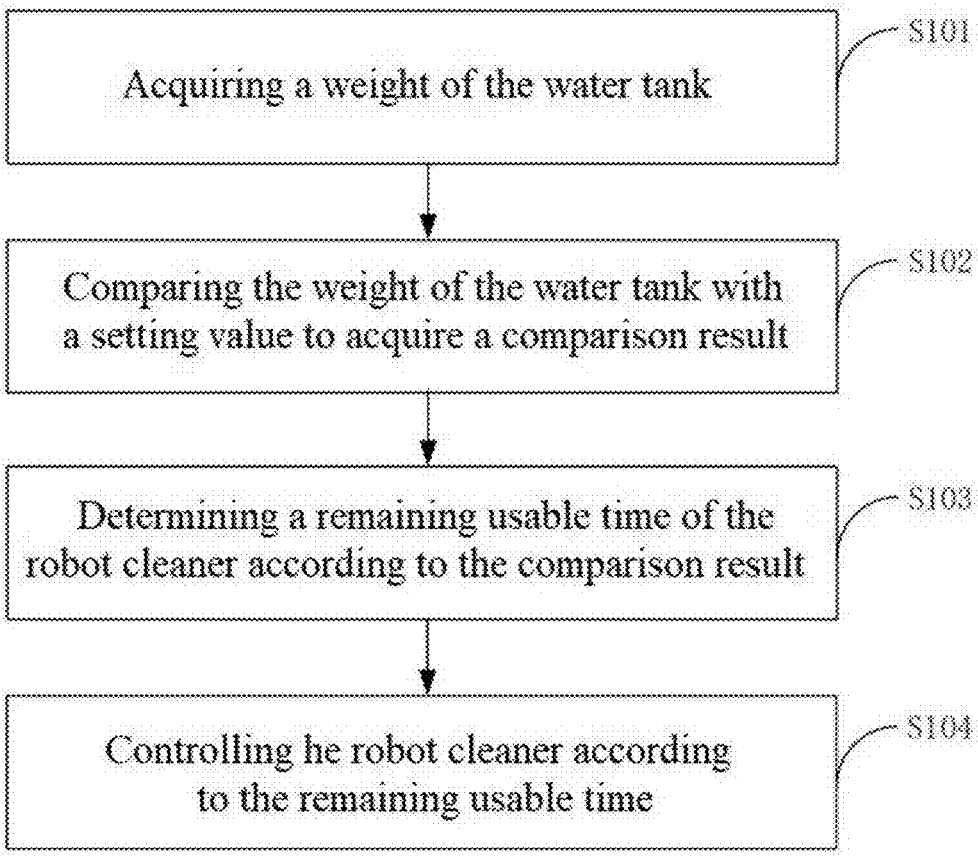
FIG. 4 is a schematic diagram illustrating an implementation flow of a method for controlling a robot cleaner in accordance with an embodiment of the present application.

Referring to FIG. 4, the method for controlling the robot cleaner in accordance with an embodiment of the present application may include steps of S101 to S104.

In S101, a weight of the water tank is acquired.

Figure 5:
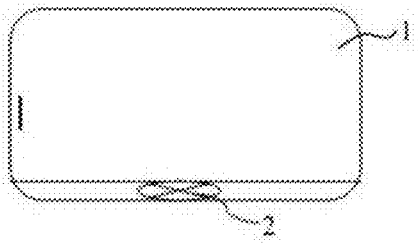
FIG. 5 is a side view of a water tank in accordance with another embodiment of the present application.

In which, the water tank, i.e., the water tank of the robot cleaner, may be a first water tank (i.e., the clean water tank) configured for containing clean water to be used in the cleaning process, or may be a second water tank (i.e., the dirty water tank) configured for containing dirty water recovered during the cleaning process. The weight of the water tank refers to a total weight of the water tank and the water in the water tank. As shown in FIG. 5, the weight of the water tank can be measured by the pressure sensor 2 located at the bottom of the water tank 1.

In S102, the weight of the water tank is compared with a setting value to acquire a comparison result.

In which, the setting value may be a weight of the water tank in a state of being filled with water, or a weight of the water tank in an anhydrous state. The comparison result between the weight of the water tank and the setting value refers to an absolute value of the difference between the weight of the water tank and the setting value.

In S103, a remaining usable time of the robot cleaner is determined according to the comparison result.

Specifically, the remaining usable time here indicates a length of time the cleaning process can be maintained by water in the water tanks. The amount of water in the water tank may be determined according to the absolute value of the difference between the weight of the water tank and the setting value. The remaining usable time of the robot cleaner can be determined according to the amount of water and a water flow speed in the water tank. Among them, a calculation of the remaining usable time may be started when the first water tank is filled with water and starts to work, or the remaining usable time may be calculated separately at each time node according to a set time node, thereby improving the accuracy of the remaining usable time calculation. The remaining usable time may also be calculated when the second water tank starts working but no dirty water has flowed into the second water tank, or the remaining usable time can be calculated separately at each time node according to the set time node, thereby improving the accuracy of the remaining usable time calculation.

In a possible implementation manner, before the remaining usable time is calculated, a working mode of the robot cleaner is acquired, where the water flow speed corresponding to each working mode is different. For example, the first water tank has different spray modes in different working modes, and different water spray modes correspond to different clean water outflow speeds; the second water tank has different suction modes in different working modes, and different suction modes correspond to different dirty water inflow speeds. After the working mode is acquired, the water flow speed is determined according to the working mode, and then the remaining usable time of the robot cleaner is calculated according to the water flow speed. The water flow speed is determined according to the working mode of the robot cleaner, which improves the accuracy of the determined water flow speed, and further improves the accuracy of the calculated remaining usable time.

In a possible implementation manner, the water tank is the first water tank, the setting value is the weight of the first water tank in the anhydrous state, and the remaining usable time equals to a ratio of the difference between the weight of the first water tank and the setting value to the water flow speed (i.e., the remaining usable time=(weight of the first water tank—setting value)/water flow speed). Since the weight of the first water tank can be obtained in real time, according to the obtained weight of the first water tank and the weight of the first water tank in the anhydrous state, the remaining usable time can be determined in real time, which improves the accuracy of the determined remaining usable time, and the calculation is simple. In other possible implementation manners, the setting value may also be the weight of the first water tank in the state of being filled with water. According to the weight of the first water tank in the state of being filled with water and the obtained weight of the first water tank, the weight of water that has been used in the first water tank can be determined in real time. According to the weight of water that has been used in the first water tank, the time the first water tank has been used after being filled with water can be determined. According to the time the first water tank has been used after being filled with water and a usable time of the first water tank when it is filled with water, the remaining usable time can be determined.

In another possible implementation, the water tank is the second water tank, the setting value is the weight of the second water tank in the state of being filled with water, and the remaining usable time equals to a ratio of the difference between the setting value and the weight of the second water tank to the water flow speed (i.e., the remaining usable time=(setting value−weight of the second water tank)/water flow speed. Since the weight of the second water tank can be obtained in real time, according to the obtained weight of the second water tank and the weight of the second water tank in the state of being filled with water, the remaining usable time can be determined in real time, which increases the accuracy of the determined remaining usable time, and the calculation is simple.

In S104, the robot cleaner is controlled according to the remaining usable time.

Specifically, whether the robot cleaner can continue cleaning can be judged based on the remaining usable time, and the robot cleaner stops and alarms when the cleaning cannot be continued.

In the above embodiment, the weight of the water tank is acquired, and the weight of the water tank is compared with the setting value to acquire the comparison result, and then the remaining usable time of the robot cleaner is determined according to the comparison result. Since the weight of the water tank is not easily interfered by other factors, the acquiring of weight has a high accuracy, thereby the remaining usable time determined according to the weight of the water tank has a high accuracy, and then the robot cleaner is controlled according to the determined remaining usable time with high accuracy. The control accuracy of the robot cleaner thus can be improved.

In a possible implementation manner, after the remaining usable time of the robot cleaner is determined, a worked time (namely, the time the robot cleaner has been worked) is obtained, based on the worked time, the remaining usable time and the comparison result of the weight of the water tank and the setting value, a state of water amount in the water tank can be determined.

Figure 6:
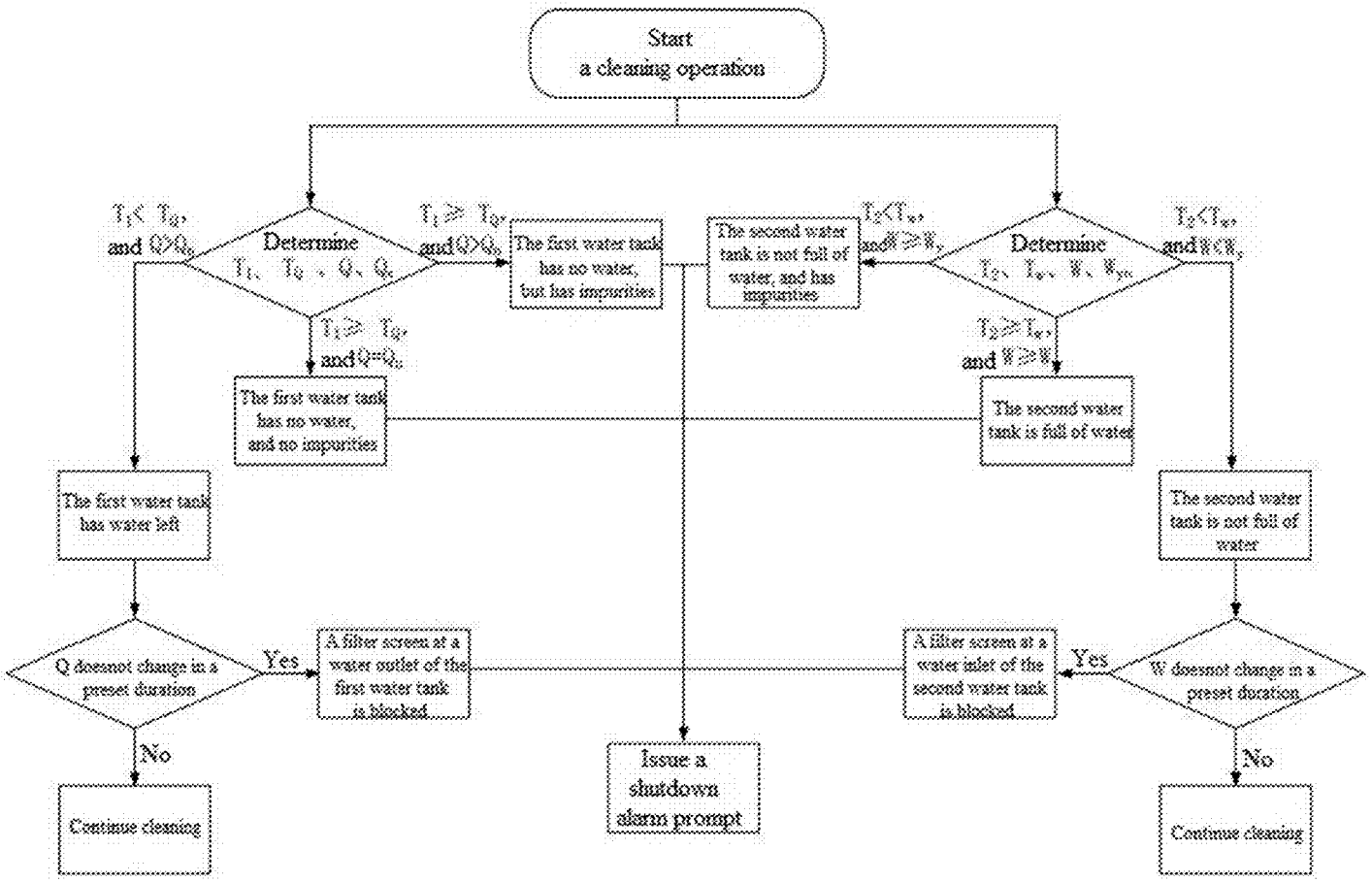
FIG. 6 illustrates the flow for determining a state of water amount in the first water tank and the second water tank in accordance with an embodiment of the present application.

Specifically, as shown in FIG. 6, after the robot cleaner starts a cleaning operation, for the first water tank, the setting value (i.e., the weight of the first water tank in the anhydrous state) $Q_n$ is obtained from an enable registration table stored by the robot cleaner. According to the working mode of the first water tank, the water flow speed corresponding to the working mode is obtained from the enable registration table, and the weight Q of the first water tank collected by the pressure sensor is also obtained. The remaining usable time $T_Q$ is calculated according to $Q_n$, Q and the water flow speed.

After $T_Q$ is calculated, the worked time $T_1$ of the robot cleaner is acquired. If $T_1 \geq T_Q$ and $Q > Q_n$, it indicates that the first water tank has reached the time when the water is used up, and the weight of the first water tank is greater than that of the first water tank in the anhydrous state, which further indicates that the first water tank has undischarged impurities, then it is determined that the first water tank has no water but has impurities. The robot cleaner issues a shutdown alarm prompt to remind the user to clean up the impurities in time. In other possible implementation manners, if it is determined that the first water tank has no water but has impurities, the robot cleaner may also perform operations of cleaning impurities and adding clean water.

If $T_1 < T_Q$ and $Q > Q_n$, it indicates that the first water tank has not reached the time when the water is used up, and the weight of the first water tank is greater than the weight of the first water tank in the anhydrous state, which further indicates that the first water tank has water left, the robot cleaner continues cleaning, so that the state of water amount in the first water tank of the robot cleaner can be obtained in real time, so as to improve the control accuracy of the robot cleaner.

If $T_1 \geq T_Q$ and $Q = Q_n$, it indicates that the first water tank has reached the time when the water is used up, and the weight of the first water tank is equal to the weight of the first water tank in the anhydrous state, then it is determined that the first water tank has no water and no impurities. The robot cleaner issues a shutdown alarm prompt to remind the user to add clean water in time. In other possible implementation manners, if it is determined that the first water tank has no water and no impurities, the robot cleaner may also perform the operation of adding clean water.

If the weight Q of the first water tank does not change within a preset duration, it indicates that no water flows out of the first water tank within the preset duration, which means that the filter screen at the water outlet of the first water tank is blocked, then the robot cleaner issues a shutdown alarm prompt to remind the user to clean the filter screen. Among them, the preset duration may be set to three minutes. In other possible implementation manners, if the weight Q of the first water tank does not change within the preset duration, the robot cleaner may also perform the operation of cleaning the filter screen.

For the second water tank, the setting value (i.e., the weight of the second water tank in the state of being filled with water) Wy is obtained from the enable registration table stored by the robot cleaner. According to the working mode of the second water tank the water flow speed corresponding to the working mode is obtained from the enable registration table, and the weight W of the second water tank collected by the pressure sensor is also obtained. The remaining usable time Tw is calculated according to Wy, W and the water flow speed.

After $T_w$ is calculated, the worked time $T_2$ of the robot cleaner is acquired. If $T_2<T_w$ and $W\geq W_y$, it indicates that the second water tank has not reached the time when it is full of water, and the weight of the second water tank is greater than that of the second water tank in the state of being filled with water, then it is determined that the second water tank is not full of water, and has impurities that have not been discharged. The robot cleaner issues a shutdown alarm prompt to remind the user to clean up the impurities in time. In other possible implementation manners, if it is determined that the second water tank is not filled with water and has impurities, the robot cleaner may also perform the operation of cleaning the impurities.

If $T_2<T_w$ and $W<W_y$, it indicates that the second water tank has not reached the time when it is full of water, and the weight of the second water tank is less than the weight of the second water tank in the state of being filled with water, then it is determined that the second water tank is not full of water, and the robot cleaner continues cleaning, so that the state of water amount in the second water tank of the robot cleaner can be obtained in real time, so as to improve the control accuracy of the robot cleaner.

If $T_2\geq T_w$ and $W\geq W_y$, it indicates that the second water tank reaches the time when it is full of water, it is determined that the second water tank is full of water. The robot cleaner issues a shutdown alarm prompt to remind the user to dump the dirty water in time. In other possible implementation manners, if it is determined that the second water tank is full of water, the robot cleaner may also perform the operation of dumping dirty water.

If the weight W of the second water tank does not change within a preset duration, it indicates that the second water tank has no water within the preset duration, which means that the filter screen at the water inlet of the second water tank is blocked, and the robot cleaner issues a shutdown alarm prompt to remind the user to clean the filter screen. Among them, the preset duration can be set to three minutes. In other possible implementation manners, if the weight W of the second water tank does not change within the preset duration, the robot cleaner may also perform the operation of cleaning the filter screen.

In the above-mentioned embodiment, the amount of water in the first water tank is determined according to the weight of the first water tank and the time it has been worked, and the amount of water of the second water tank is determined according to the weight of the second water tank and the time it has been worked, which increases the accuracy of the determined water amount of the first water tank and the determined water amount of the second water tank. The robot cleaner is controlled according to the amount of water of the first water tank and the amount of water of the second water tank, which improves the control accuracy of the robot cleaner.

It should be understood that the sequence number of each step in the foregoing embodiment does not mean the order of execution, and the execution sequence of each process should be determined by its function and internal logic, and should not constitute any limitation to the implementation process of the embodiment of the present application.

Figure 7:
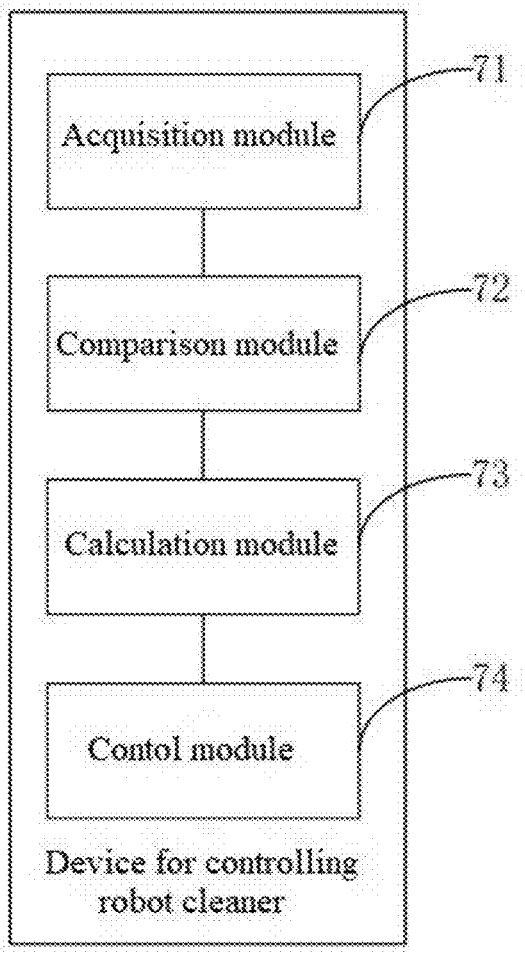
FIG. 7 is a schematic diagram of a device for controlling a robot cleaner in accordance with an embodiment of the present application.

Corresponding to the method described in the above embodiment, FIG. 7 shows a structural block diagram of a device for controlling a robot cleaner in accordance with an embodiment of the present application. For ease of illustration, only parts relevant to the embodiment of the present application are shown.

As shown in FIG. 7, the device for controlling the robot cleaner includes an acquisition module 71, a comparison module 72, a calculation module 73, and a control module 74. The acquisition module 71 is configured to acquire a weight of the water tank. The comparison module 72 is configured compare the weight of the water tank with a setting value to acquire a comparison result. The calculation module 73 is configured to determine a remaining usable time of the robot cleaner according to the comparison result. The control module 74 is configured to control the robot cleaner according to the remaining usable time.

In a possible implementation manner, the calculation module 73 is specifically configured to acquire a working mode of the robot cleaner, and determine the remaining usable time of the robot cleaner according to the comparison result and the working mode.

In a possible implementation manner, the device for controlling the robot cleaner further includes a determining module. The determining module is configured to acquire a worked time of the robot cleaner, and to determine a state of water amount in the water tank according to the worked time, the remaining usable time and the comparison result.

In a possible implementation manner, the water tank includes a first water tank configured for containing clean water to be used in a cleaning process, and the setting value is the weight of the first water tank in an anhydrous state.

In a possible implementation manner, the determining module is specifically configured to determine that the first water tank has no water but has impurities, when the worked time is greater than or equal to the remaining usable time and the weight of the first water tank is greater than the weight of the first water tank in an anhydrous state.

In a possible implementation manner, the determining module is specifically configured to determine that the first water tank has water left, when the worked time is less than the remaining usable time and the weight of the first water tank is greater than the weight of the first water tank in the anhydrous state.

In a possible implementation manner, the determining module is specifically configured to determine that the first water tank has no water and no impurities, when the worked time is greater than or equal to the remaining usable time and the weight of the first water tank is equal to the weight of the first water tank in the anhydrous state.

In a possible implementation manner, the water tank includes a second water tank for containing dirty water recovered in the cleaning process, and the setting value is a weight of the second water tank in a state of being filled with water.

In a possible implementation manner, the determining module is specifically configured to determine that the second water tank is not full of water and have impurities, when the worked time is less than the remaining usable time and the weight of the second water tank is greater than or equal to the weight of the second water tank in the state of being filled with water.

In a possible implementation manner, the determining module is specifically configured to determine that the second water tank is not full of water, when the worked time is less than the remaining usable time and the weight of the second water tank is less than the weight of the second water tank in the state of being filled with water.

In a possible implementation manner, the determining module is specifically configured to determine that the second water tank is full of water, when the worked time is greater than or equal to the remaining usable time and the weight of the second water tank is greater than or equal to the weight of the second water tank in the state of being filled with water.

In a possible implementation manner, the determining module is further configured to determine that a filter screen of the water tank is blocked, when the weight of the water tank does not change within a preset duration.

It should be noted that the information interaction and execution process between the above-mentioned devices/units are based on the same concept as the method embodiment of the present application, and its specific functions and technical effects can be found in the method embodiment section, which will not be repeat it here.

Figure 8:
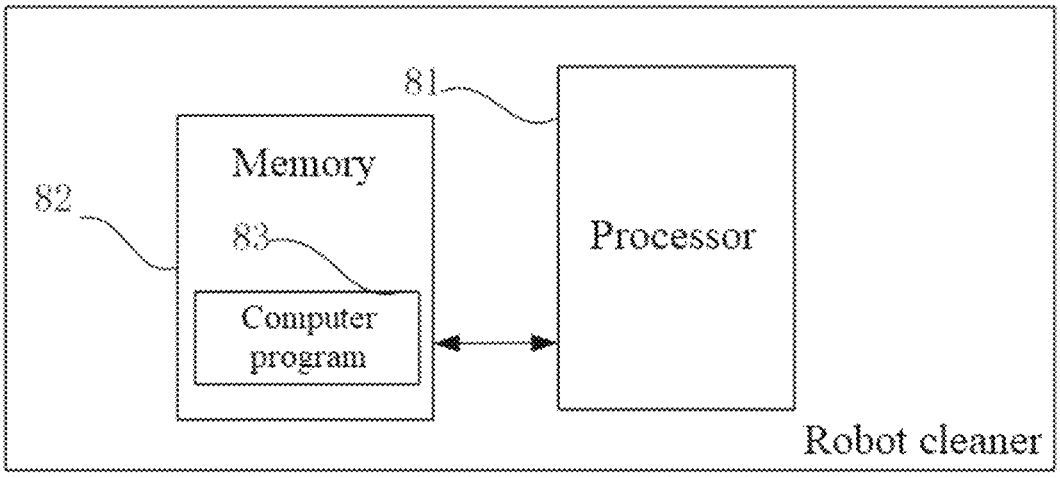
FIG. 8 is a schematic diagram of a robot cleaner in accordance with an embodiment of the present application.

FIG. 8 is a schematic diagram of a robot cleaner in accordance with an embodiment of the present application. As shown in FIG. 8, the robot cleaner in this embodiment includes a processor 81, a memory 82, and a computer program 83 stored in the memory 82 and running on the processor 81. The processor 81 is configured to implement the steps in the foregoing method embodiment when the computer program 83 is executed, for example, steps S101 to S104 shown in FIG. 4. Alternatively, when the computer program 83 is executed by the processor 81, the functions of the modules/units in the foregoing device embodiments are implemented, for example, the functions of the acquisition module 71 to the control module 74 shown in FIG. 7.

Exemplarily, the computer program 83 may be divided into one or more modules/units, and the one or more modules/units are stored in the memory 82 and executed by the processor 81 to implement solutions of the present application. The one or more modules/units may be a series of computer program instruction segments capable of completing specific functions, and the instruction segments are used to describe the execution process of the computer program 83 in the robot cleaner.

It should be understood to those skilled in the art that FIG. 8 is only an example of a robot cleaner, and does not constitute a limitation on the robot cleaner. It may include more or less parts than shown in the figure, or a combination of certain parts, or different parts. Exemplarily, the robot cleaner may also include input and output devices, network access devices, buses, and the like.

The processor 81 may be a central processing unit (CPU), other general-purpose processors, digital signal processors (DSP), application specific integrated circuits (ASIC), field-programmable gate array (FPGA) or other programmable logic devices, discrete gates or transistor logic devices, discrete hardware components, etc. The general-purpose processor may be a microprocessor or the processor may also be any conventional processor or the like.

The memory 82 may be an internal storage unit of the robot cleaner, such as a hard disk or memory of the robot cleaner. The memory 82 may also be an external storage device of the robot cleaner, such as a plug-in hard disk, a smart memory card (SMC), a secure digital (SD) card, and a flash card, etc. equipped on the robot cleaner. Further, the memory 82 may also include both an internal storage unit of the robot cleaner and an external storage device. The memory 82 is used to store the computer program and other programs or data required by the robot cleaner. The memory 82 may also be used to temporarily store data that has been output or will be output.

In the foregoing embodiments, the description of each embodiment has its own emphasis. For parts that are not described in detail or recorded in an embodiment, reference may be made to related descriptions of other embodiments.

It should be clearly understood to those skilled in the art that, for the convenience and conciseness of description, only the division of the above-mentioned functional units and modules is used as an example. In practical applications, the above functions can be allocated to different functional units and modules according to actual needs. That is, the internal structure of the device may be divided into different functional units or modules to complete all or part of the functions described above. The functional units and modules in the embodiments can be integrated into one processing unit, or each unit can exist alone physically, or two or more units can be integrated into one unit. The above-mentioned integrated units can be realized in the form of hardware, and can also be realized in the form of software functional units. In addition, the specific terms referring to the functional units and modules are only for the convenience of distinguishing each other, and are not used to limit the protection scope of the present application. For specific working processes of the units and modules in this system, reference may be made to the corresponding processes in the method embodiment, which will not be repeated here.

The units described as separate components may or may not be physically separated, and the components displayed as units may or may not be physical units, that is, they may be located in one place, or they may be distributed on multiple network units. Some or all of the units may be selected according to actual needs to achieve the objects of the solutions in the embodiments.

If the integrated module/unit is implemented in the form of a software functional unit and sold or used as an independent product, it can be stored in a computer readable storage medium. Based on this understanding, the implementation of all or part of the processes in the above-mentioned method embodiments of the present application can also be completed through an execution of computer programs by relevant hardware. The computer program can be stored in a computer-readable storage medium. When the program is executed by the processor, the steps of the foregoing method embodiments can be implemented. In which, the computer program includes computer program code, and the computer program code may be in the form of source code, object code, executable file, or some intermediate forms. The computer-readable medium may include any entity or device capable of carrying the computer program code, recording medium, U disk, mobile hard disk, magnetic disk, optical disk, computer memory, read-only memory (ROM), random access memory (RAM), electrical carrier signal, telecommunications signal, and software distribution media, etc.

It may be noted to those of ordinary skill in the art that the units and algorithm steps of the examples described in the embodiments disclosed in this disclosure can be implemented by electronic hardware or by a combination of computer software and electronic hardware. Whether these functions are executed by hardware or software depends on the specific application and design constraint conditions of the technical solution. Professionals and technicians may use different methods for each specific application to implement the described functions, but such implementation should not be considered beyond the scope of the present application.

The above-mentioned embodiments are only used for illustration of the technical solutions of the present application, rather than limitation. Although the present application has been described in detail with reference to the foregoing embodiments, it should be understood to those of ordinary skill in the art that the technical solutions recorded in the examples may be modified, or some of the technical features may be equivalently replaced; and these modifications or replacements do not cause the essence of the corresponding technical solutions to deviate from the spirit and scope of the technical solutions of the embodiments of the present application, and should be included within the protection scope of the present application.

What is claimed is:

1. A method for controlling a robot cleaner, applied to a robot cleaner, the robot cleaner comprising a water tank, the method for controlling the robot cleaner comprising:

acquiring a weight of the water tank;

comparing the weight of the water tank with a setting value to acquire a comparison result;

determining a remaining usable time of the robot cleaner according to the comparison result; and controlling the robot cleaner according to the remaining usable time, wherein, after the weight of the water tank is acquired, determining that a filter screen of the water tank is blocked when the weight of the water tank does not change within a preset duration.

2. The method for controlling the robot cleaner according to claim 1, wherein the determining a remaining usable time of the robot cleaner according to the comparison result comprises:

determining the remaining usable time of the robot cleaner according to the comparison result and a working mode of the robot cleaner.

3. The method for controlling the robot cleaner according to claim 1, wherein, after the remaining usable time of the robot cleaner is determined according to the comparison result, the method further comprises:

acquiring a worked time of the robot cleaner; and determining a state of water amount of the water tank according to the worked time, the remaining usable time, and the comparison result.

4. The method for controlling the robot cleaner according to claim 3, wherein the water tank comprises a first water tank configured for containing clean water to be used in a cleaning process, and the setting value is a weight of the first water tank in an anhydrous state.

5. The method for controlling the robot cleaner according to claim 4, wherein the determining a state of water amount of the water tank according to the worked time, the remaining usable time, and the comparison result comprises:

determining that the first water tank has no water but has impurities, when the worked time is greater than or equal to the remaining usable time, and the weight of the first water tank is greater than the weight of the first water tank in the anhydrous state.

6. The method for controlling the robot cleaner according to claim 4, wherein the determining a state of water amount of the water tank according to the worked time, the remaining usable time, and the comparison result comprises:

determining that the first water tank has water left, when the worked time is less than the remaining usable time, and the weight of the first water tank is greater than the weight of the first water tank in the anhydrous state.

7. The method for controlling the robot cleaner according to claim 4, wherein the determining a state of water amount of the water tank according to the worked time, the remaining usable time, and the comparison result comprises:

determining that the first water tank has no water and no impurities, when the worked time is greater than or equal to the remaining usable time, and the weight of the first water tank is equal to the weight of the first water tank in the anhydrous state.

8. The method for controlling the robot cleaner according to claim 3, wherein the water tank comprises a second water tank configured for containing dirty water recovered in the cleaning process, and the setting value is a weight of the second water tank in a state of being filled with water.

9. The method for controlling the robot cleaner according to claim 8, wherein the determining a state of water amount of the water tank according to the worked time, the remaining usable time, and the comparison result comprises:

determining that the second water tank is not full of water and has impurities, when the worked time is less than the remaining usable time, and the weight of the second water tank is greater than or equal to the weight of the second water tank in the state of being filled with water.

10. The method for controlling the robot cleaner according to claim 8, wherein the determining a state of water amount of the water tank according to the worked time, the remaining usable time, and the comparison result comprises:

determining that the second water tank is not full of water, when the worked time is less than the remaining usable time, and the weight of the second water tank is less than the weight of the second water tank in the state of being filled with water.

11. The method for controlling the robot cleaner according to claim 8, wherein the determining a state of water amount of the water tank according to the worked time, the remaining usable time, and the comparison result comprises:

determining that the second water tank is not full of water, when the worked time is greater than or equal to the remaining usable time, and the weight of the second water tank is greater than or equal to the weight of the second water tank in the state of being filled with water.

12. A robot cleaner, comprising a water tank, a memory, a processor, and a computer program stored in the memory and running on the processor, wherein the processor, by executing the computer program, is configured to:

acquire a weight of the water tank;

compare the weight of the water tank with a setting value to acquire a comparison result;

determine a remaining usable time of the robot cleaner according to the comparison result; and control the robot cleaner according to the remaining usable time, wherein, after the weight of the water tank is acquired, determining that a filter screen of the water tank is blocked when the weight of the water tank does not change within a preset duration.

13. A non-transitory computer-readable storage medium, wherein the computer-readable storage medium stores a computer program, wherein the computer program, executable by a process, cause the processor to perform operations that comprises:

acquiring a weight of a water tank of a robot cleaner;

comparing the weight of the water tank with a setting value to acquire a comparison result;

determining a remaining usable time of the robot cleaner according to the comparison result; and controlling the robot cleaner according to the remaining usable time, wherein, after the weight of the water tank is acquired, determining that a filter screen of the water tank is blocked when the weight of the water tank does not change within a preset duration.

* * * * *